US006439865B1

(12) United States Patent
Garczorz et al.

(10) Patent No.: US 6,439,865 B1
(45) **Date of Patent: *Aug. 27, 2002**

(54) VACUUM PUMP

(75) Inventors: Reinhard Garczorz, Lörrach; Fritz-Martin Scholz, Hasel, both of (DE)

(73) Assignee: Werner Rietschle GmbH & Co. KG, Schopfheim (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/673,641

(22) PCT Filed: Apr. 28, 1999

(86) PCT No.: PCT/EP99/02882

§ 371 (c)(1),
(2), (4) Date: Dec. 21, 2000

(87) PCT Pub. No.: WO99/57439

PCT Pub. Date: Nov. 11, 1999

(30) Foreign Application Priority Data

Apr. 30, 1998 (DE) ..... 198 19 538

(51) Int. Cl.[7] ..... F03C 2/00

(52) U.S. Cl. ..... 418/15; 418/191; 418/206.2; 418/206.4

(58) Field of Search ..... 418/15, 206.2, 418/206.4, 191

(56) References Cited

U.S. PATENT DOCUMENTS

| | | | | |
|---|---|---|---|---|
| 2,764,407 A | | 9/1956 | Alix | |
| 2,967,054 A | | 1/1961 | Glucksman | |
| 3,199,771 A | | 8/1965 | Becker | |
| 3,628,893 A | * | 12/1971 | Carpigiani | 418/15 |
| 3,764,238 A | * | 10/1973 | Carpigiani | 418/15 |
| 4,008,019 A | * | 2/1977 | Carling | 418/15 |
| 4,480,970 A | * | 11/1984 | Smith | 418/15 |
| 4,859,158 A | | 8/1989 | Weinbrecht | |
| 5,071,328 A | * | 12/1991 | Schlictig | 418/15 |

FOREIGN PATENT DOCUMENTS

| | | | | |
|---|---|---|---|---|
| DE | 142 587 | | 3/1902 | |
| DE | 564 152 | | 10/1932 | |
| DE | 1 133 500 | | 7/1962 | |
| DE | 1915269 A | * | 8/1970 | 418/15 |
| DE | 1 915 269 | | 10/1970 | |
| DE | 1 628 347 | | 6/1971 | |
| DE | 20 27 272 | | 12/1971 | |

(List continued on next page.)

OTHER PUBLICATIONS

Gunter Leuschner: "Kleines Pumpenhandbuch fur Chemie und Technik," 1967, VERLAG CHEMIE GMBH, WEINHEIM/BERGSTR. XP002113407, Seite 226, Letzter Absatz–Seite 227, Letzter Absatz; Abbildung 4.13.2.
"Pulsationsfreie Drehkolbenpumpen", p. 104, Jun. 2, 1998, Industriepumpen & Kompressoren.
De Vries, English–German Technical and Engineering Dictionary, p. 730, 1954, First Edition.

*Primary Examiner*—Thomas Denion
*Assistant Examiner*—Theresa Trieu
(74) *Attorney, Agent, or Firm*—Nixon Peabody LLP; Stuart J. Friedman

(57) ABSTRACT

In order to simultaneously generate pressure and negative pressure with a single-stage pump, said pump has a pump chamber (18) that is formed in a housing and that is provided with a suction port, a pressure port and a charging port. There is a pair of rotors (30, 32) in the pump chamber (18) that has at least three blades and that rotates in opposite directions around parallel spaced axes and the rotors intermesh free of contact and, together with the peripheral wall of the pump chamber (18), they define cells **(60, 62*a*, 62*b*, 64)** that are separate from each other.

5 Claims, 5 Drawing Sheets

FOREIGN PATENT DOCUMENTS

| | | | | | |
|---|---|---|---|---|---|
| DE | 24 22 857 | | | 11/1975 | |
| DE | 33 21 992 | | | 3/1984 | |
| DE | 41 18 843 | | | 2/1993 | |
| DE | 195 03 716 | | | 3/1996 | |
| EP | 0 290 662 | | | 11/1988 | |
| EP | 0 370 117 | | | 5/1990 | |
| EP | 0 426 078 | | | 5/1991 | |
| EP | 0 458 134 | | | 11/1991 | |
| EP | 0 475 535 | | | 3/1992 | |
| EP | 0 578 853 | | | 1/1994 | |
| EP | 0 680 562 | | | 4/1997 | |
| GB | 622873 | A | * | 5/1949 | ..... 418/15 |
| GB | 818 691 | | | 8/1959 | |
| GB | 1 350 636 | | | 4/1974 | |
| GB | 2233042 | A | * | 1/1991 | ..... 418/15 |

* cited by examiner

VACUUM PUMP

FIELD OF THE INVENTION the invention relates to a pump for simultaneously generating pressure and negative pressure.

BACKGROUND OF THE INVENTION

Such pumps are advantageous if an industrial process requires compressed air and negative pressure at the same time, since the pump only needs one drive. Aside from the suction port, such a pump requires a separate charging port that is connected to the atmosphere in order to ensure the volume flow for the compressed air. Accordingly, the pump chamber has to have several cells that are separated from each other. In the state of the art, this has only been achieved with vane type pumps which are known, for example, from the GB-A-818 691. Vane type pumps, however, are prone to wear and tear, and can only be operated without lubricants when special materials are used.

SUMMARY OF THE INVENTION

The present invention provides a pump for simultaneously generating compressed air and negative pressure, that is virtually free of wear and tear and that can be made without the use of special materials. In the pump according to the invention, there is a pair of rotors in the pump chamber that has at least three blades and that rotates in opposite directions around parallel spaced axes and these rotors intermesh free of contact so that, together with the peripheral wall of the pump chamber, they define cells that are separate from each other. The cells needed for simultaneously generating compressed air and vacuum can be separated from each other by means of the rotors. Since the rotors interact free of contact with each other and with the peripheral wall of the pump chamber, no wear occurs in the area of the pump chamber. The sealing gap between the rotors can be kept very small by optimizing their geometry; in practical embodiments, the gap is just fractions of a millimeter, so that good pressure and vacuum values are ensured. These values even improve with increasing service life since the deposits that form over time reduce the size of the sealing gaps.

A pump with a pair of rotors each having three blades and rotating in opposite directions around parallel axes is known from the DE-A-2 422 857. That pump is not equipped, however, with a charging port and is therefore not suited for producing compressed air and negative pressure at the same time.

The pump according to the invention is particularly well suited for use in the paper-processing industry, especially for applications that do not require a separate supply or adjustment of compressed air and vacuum. Compressed air is needed, for example, to blow air onto a stack of paper from the side to help separate the sheets. The generation of pulsating compressed air by the pump according to the invention proves to be very practical here since the paper edges can be separated more easily by means of the pulsating compressed air that is generated. Negative pressure is required in such applications to pick up the top sheet of paper.

In the preferred embodiment of the pump, the rotors, together with the pump chamber, define a suction cell that is connected to the suction port and whose volume increases during the rotation of the rotors and they also define a pressure cell whose volume decreases when the rotors rotate and that is connected to the pressure port. This pressure cell is comprised of two charging cells that are initially separated from each other during the rotation of the rotors, whereby these charging cells each have an associated charging port and that, during the further rotation of the rotors, are united with each other to define the pressure cell. Before being united, the charging cells are moved essentially isobarically and isochorically in the pump chamber, that is to say, the air present in the charging cells essentially does not undergo any change in pressure or volume during the shift of the charging cells.

DESCRIPTION OF THE DRAWINGS

Other advantages and features of the invention ensue from the description below of a preferred embodiment and from the drawing to which reference is made. The following is shown in the drawing.

DESCRIPTION OF THE PREFERRED EMBODIMENTS

Figure 1:
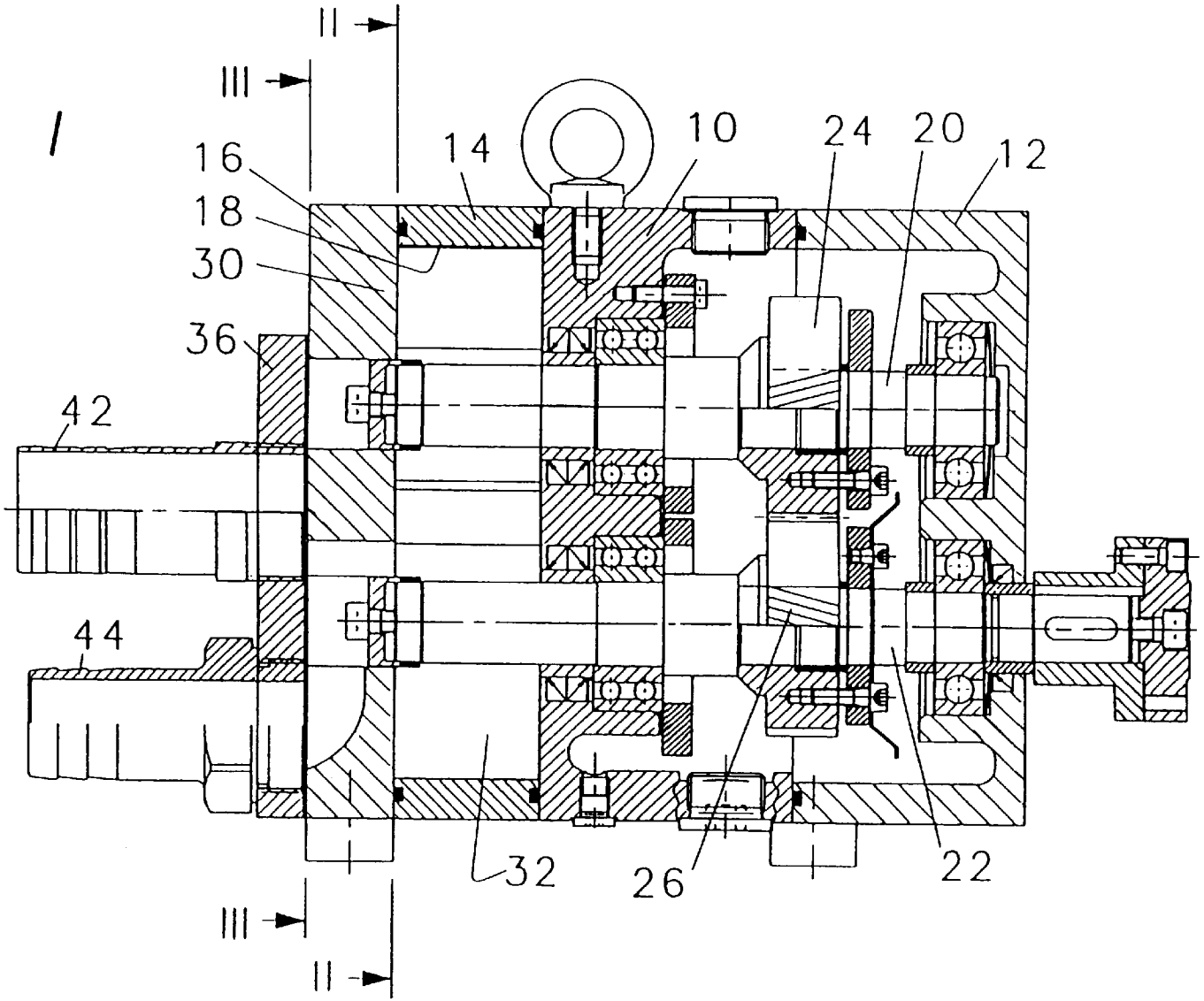
FIG. 1 a longitudinal section of the pump according to the invention.
Figure 3:
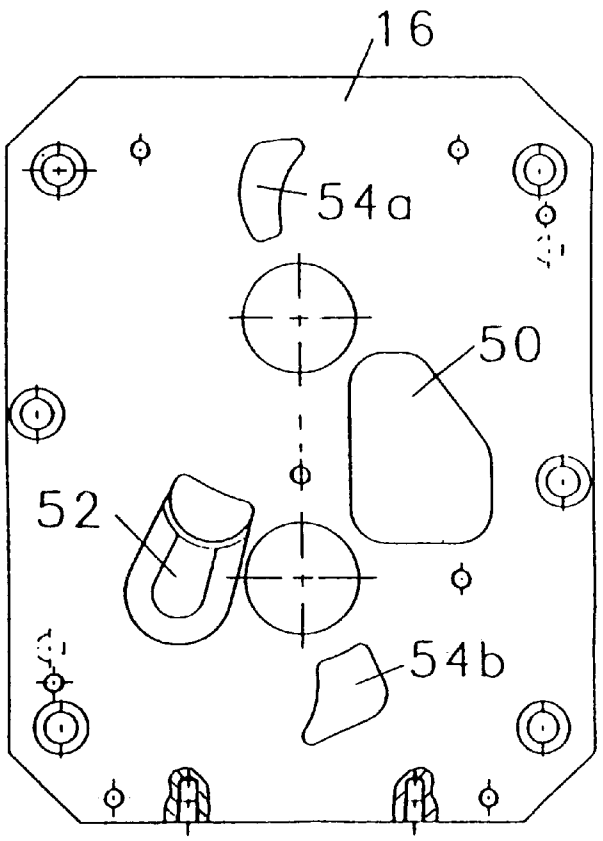
FIG. 3 a view along line III—III in FIG. 1.
Figure 2:
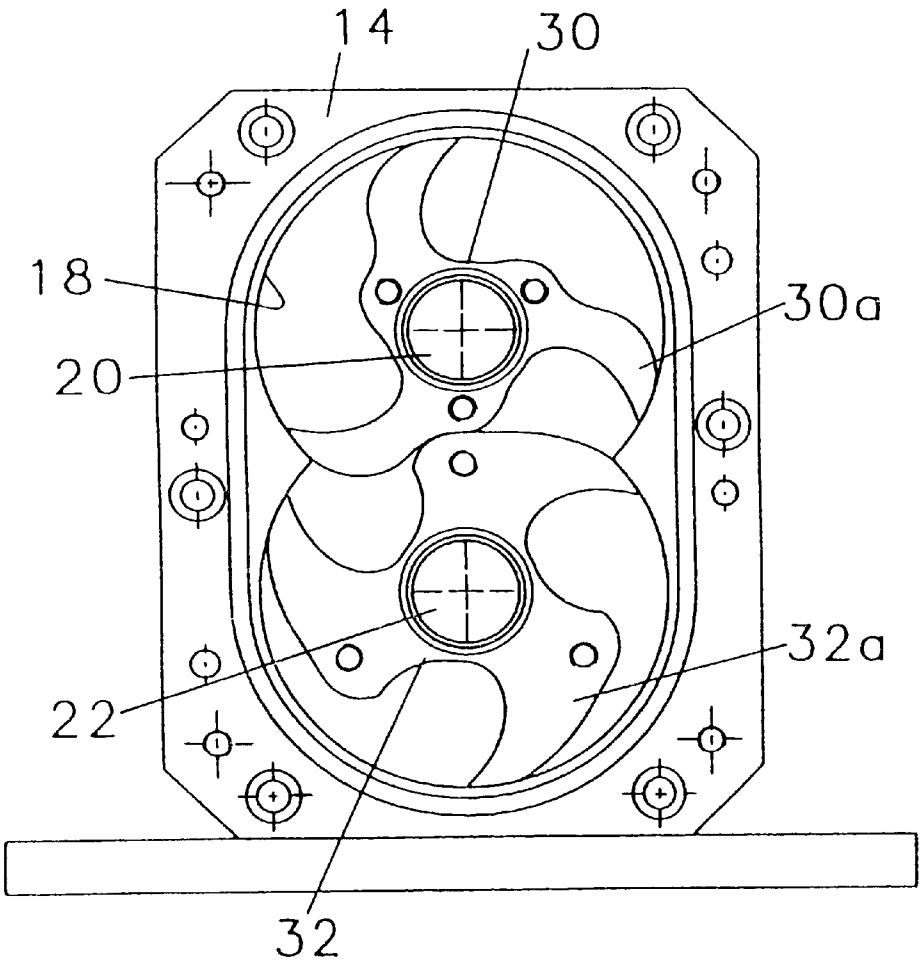
FIG. 2 a view along line II—II in FIG. 1.

The single-stage pump for simultaneously generating pressure and negative pressure has a housing that consists of a load-bearing middle part 10, a housing cover 12 mounted on one side of the middle part 10, a housing ring 14 affixed to the other side of the middle part 10 and a cover plate 16 adjacent to the housing ring 14. A pump chamber 18 is formed between the middle part 10, the housing ring 14 and the cover plate 16. Two shafts 20,22 are cantilevered parallel to each other in ball bearings and spaced with respect to each other in the wall parts of the housing cover 12 and of the middle part 10 facing each other. A pinion 24, 26 is mounted on each shaft 20,22. The pinions 24,26 intermesh with each other so that the shafts 20,22 rotate with each other synchronously in opposite directions. For the rotating drive unit, the lower shaft 22 projects out of the housing cover 12.

A pair of rotors 30,32 are arranged on the free ends of the shafts 20,22 that extend into the pump chamber 14. Since the load application point formed by the rotors 30,32 is not located between but rather outside of the bearings, the result is a cantilevered shaft bearing. Each of the rotors 30,32 has three blades 30*a* and 32*a* respectively. Seen from the side, the pump chamber 18 has the shape of two intersecting circles that are joined together in a figure-eight pattern. The blades 30*a* of the rotor 30 have a shape that differs from the shape of the blade 32*a* of the rotor 32. The geometry of the blades 30*a*,32*a* and of the pump chamber 18 is configured in such a way that, when the rotors 30,32 rotate, several separate cells are defined—as is explained in greater detail below with reference to FIGS. 4*a* through 4*h*—in that the blades 30*a*, 32*a* slide free of contact above each other and along the outer perimeter of the pump chamber 18 with a sealing gap of a fraction of 1 mm.

The cover plate 16 is provided with a number of recesses that are closed off towards the outside by a mounted closure plate 36. Two flanged sockets 42, 44 are screwed into the closure plate 36. The upper flanged socket 42 forms the suction port and is connected with a recess 50 of the cover plate 16. The lower flanged socket 44 forms the pressure port and is connected with a recess 52 of the cover plate 16. Two additional recesses 54*a*, 54*b* in the cover plate 16 are open towards the outside to the atmosphere and form charging ports.

Figure 4C:
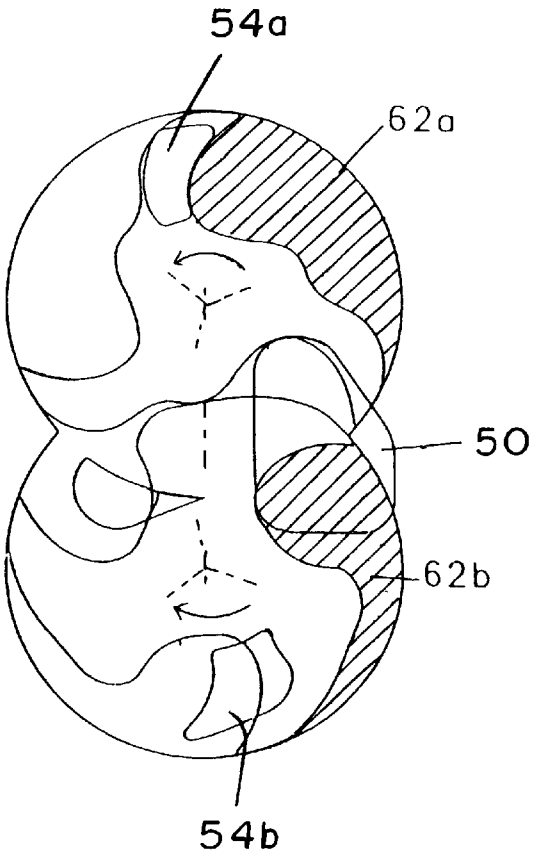
FIGS. 4*a* to 4*h* schematic views of various rotor positions to explain the mode of operation.
Figure 4B:
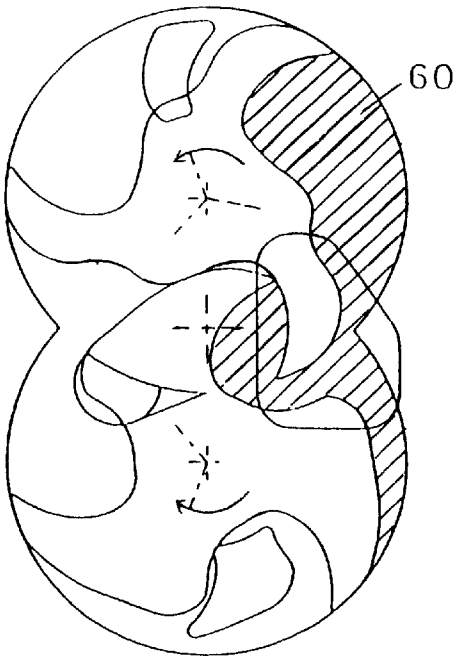
Figure 4A:
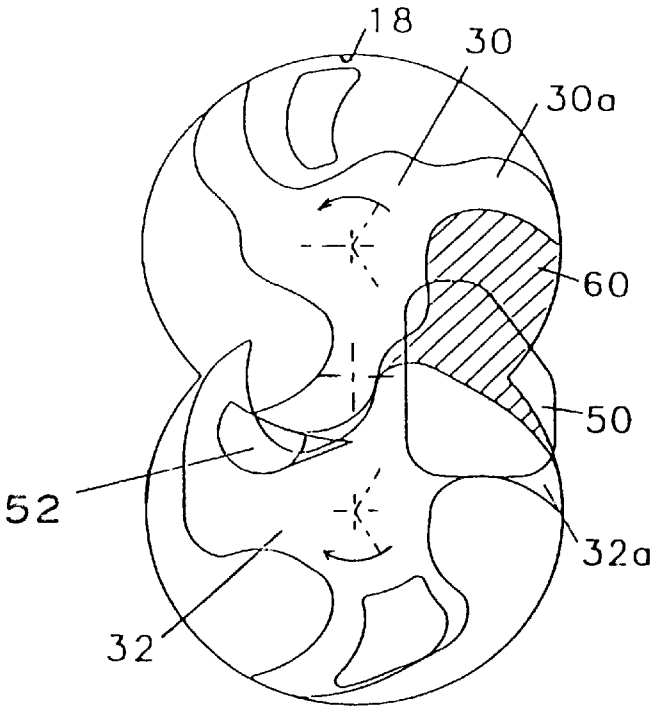

FIG. 4*a* shows the rotors 30, 32 in a rotating position in which their blades 30*a*, 32*a*, together with the wall of the pump chamber 18, define a closed joint cell 60 that is only connected to the recess 50. The volume of this cell 60 increases during the further rotation of the rotors 30, 32 as can be seen in FIG. 4*b*. Thus, this cell 60 is a suction cell.

Figure 4E:
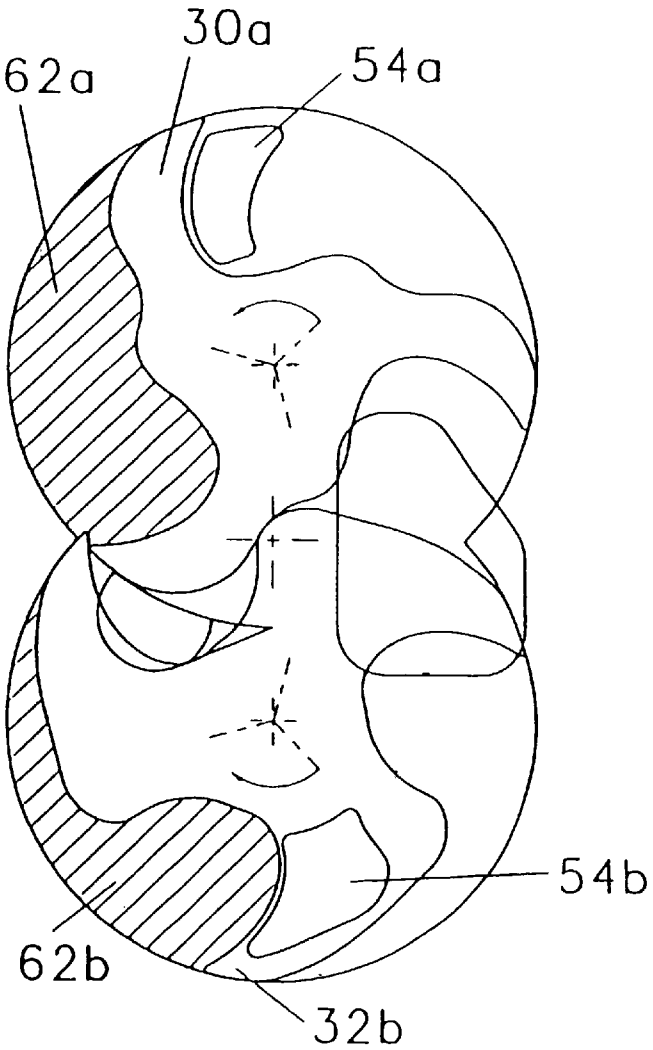
Figure 4D:
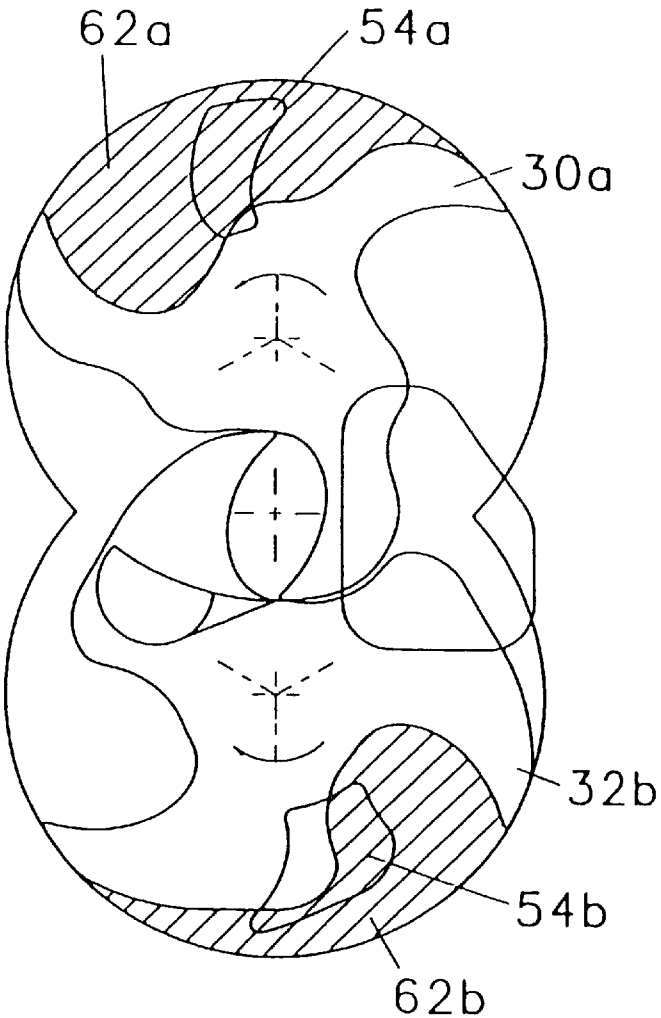
Figure 4H:
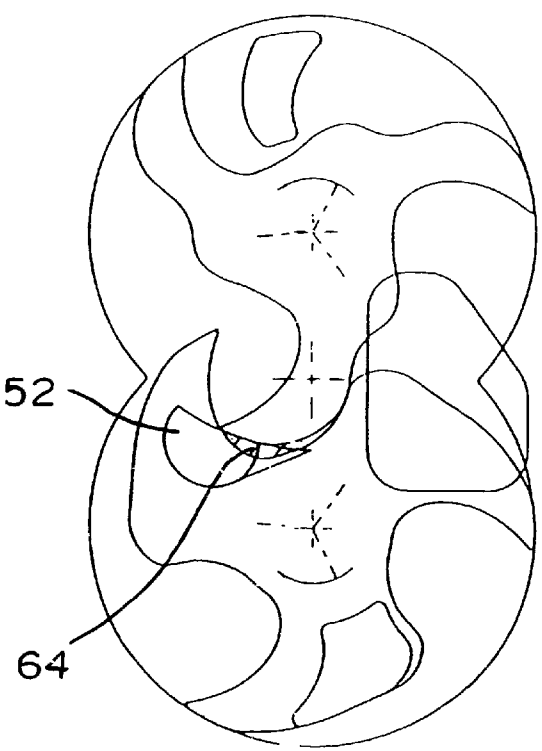
Figure 4G:
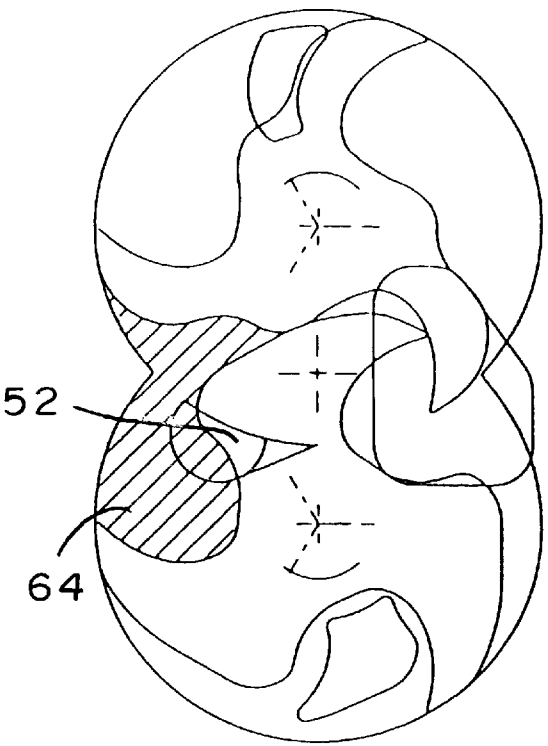
Figure 4F:
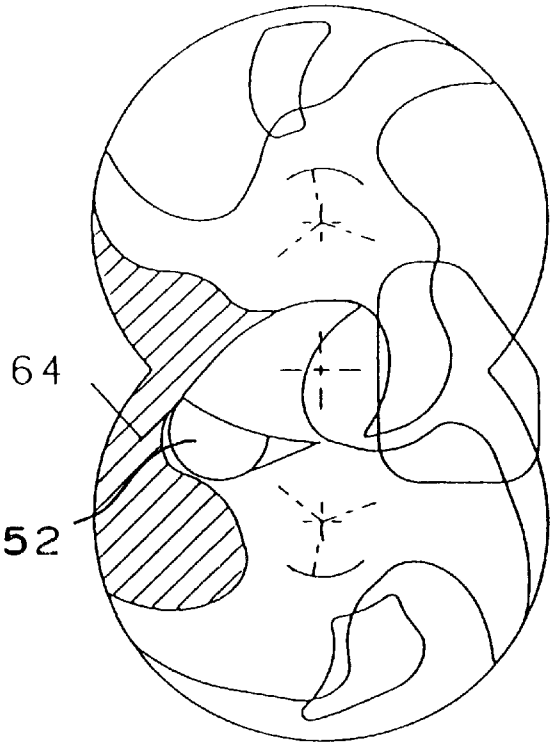

FIG. 4*c* shows two cells 62*a*, 62*b* separate from each other, which are formed immediately after the state shown in FIG. 4*b* when the cell 60 was separated into two partial cells. The cell 62*a* associated with the rotor 30 is already adjacent to the recess 54*a*, and the cell 62*b* associated with the rotor 32 is approaching the recess 54*b*. In FIG. 4*d*, the cells 62*a*, 62*b* are connected to the recesses 54*a* and 54*b* respectively that lead to the atmosphere and they are filled up with air and charged at ambient pressure, so that the air mass flow is increased. Therefore, these cells 62*a*, 62*b* are charging cells. After these charging cells 62*a*, 62*b* are separated from the associated recess 54*a* and 54*b* by the lagging blades 30*a* and 32*b*, as shown in FIG. 4*e*, the cells 62*a*, 62*b* are isobarically and isochorically moved until, as shown in FIG. 4*f*, they unite with each other to define a pressure cell 64. With the further rotation of the rotors 30, 32, the volume of the pressure cell 64 decreases. The air compressed in the pressure cell 64 is pushed out via the recess 52 to the flanged socket 44, as is illustrated in FIGS. 4*g* and 4*h*.

The pump chamber 18 is free of any lubricant since the rotors 30, 32 operate free of contact. Towards the drive side, the pump chamber 18 is sealed off by gaskets positioned on the shafts 20, 22.

Due to the cantilevered arrangement of the rotors 30, 32 on the shafts 20, 22, which gives rise to a cantilevered bearing, access to the pump chamber is facilitated, since only the cover plate 16 needs to be removed in order to provide access. The cooling is also facilitated by this arrangement. For cooling purposes, the housing can be provided with cooling ribs and, by means of a cooling fan situated on one side of the housing cover 12, cooling air blows from the cover plate 16 over the housing ring 14, the middle part 10 and the housing cover 12.

A resonance damper that is harmonized with the operating frequency of the pump serves to muffle the operating noises. Due to the three-blade configuration of the rotors, this frequency amounts to three times the rotational speed of the shafts 20, 22. The elevated operating frequency simplifies the installation of the resonance damper since its length is correspondingly reduced.

The described cantilevered bearing of the rotors is advantageous up to a volume flow of about 300 $m^3/h$. Pumps with a larger volume flow are preferably configured with rotors supported on both sides. In this case, recesses for the connections are left open in both side plates.

What is claimed is:

1. A pump for simultaneously generating pressurized air and vacuum, comprising a pump chamber within a housing, said pump chamber having a suction port, a pressure port and a pair of charging ports connected to atmosphere, wherein said pump chamber accommodates a pair of rotors rotating in opposite directions around parallel axes spaced from each other, each rotor having at least three claw-shaped blades;

said rotors intermesh free of contact so that, together with a peripheral wall of said pump chamber, they define cells that are separate from each other;

said rotors, together with said pump chamber, define a suction cell that is connected to said suction port and whose volume increases during rotation of said rotors;

upon further rotation of said rotors, said suction cell separates into a pair of separate charging cells;

upon further rotation of said rotors, each charging cell passes across an associated one of said charging ports;

said charging cells on further rotation of said rotors merge into a pressure cell;

said pressure cell on further rotation of said rotors decreases in volume;

said pressure cell being connected to said outlet port on further rotation of said rotors for pushing air out from said pressure cell through said outlet port.

2. The pump according to claim 1, wherein said pump chamber is free of lubricant.

3. The pump according to claim 1, wherein said pump chamber is delimited between two parallel side plates and recesses for said ports are left open in at least one of said side plates.

4. The pump according to claim 1, wherein said shafts are cantilevered and said rotors are arranged on free ends of said shafts.

5. The pump according to claim 1, wherein said shafts are synchronized by two pinions that intermesh with each other and in that at least one of said rotors being adjustably attached to an associated shaft.

* * * * *